US005340086A

United States Patent [19]

Dorr

[11] Patent Number: 5,340,086

[45] Date of Patent: Aug. 23, 1994

[54] PROTECTIVE BARB COVERINGS FOR BARBED WIRE

[76] Inventor: Sandra L. Dorr, 1755 S. Highway 83, Franktown, Colo. 80116

[21] Appl. No.: 30,836

[22] Filed: Mar. 12, 1993

[51] Int. Cl.[5] ..... E04H 17/04

[52] U.S. Cl. ..... 256/3; 256/4; 256/1; 220/4.23; 24/113 MP

[58] Field of Search ..... 256/1–9, 256/19, 11, 12; 24/91, 113 MP; 220/4.22, 4.23, 4.25

[56] References Cited

U.S. PATENT DOCUMENTS

| | | | |
|---|---|---|---|
| 170,024 | 11/1875 | Seabury | 256/4 X |
| 294,572 | 3/1884 | Boone, Jr. | 256/4 |
| 297,487 | 4/1884 | Bacon | 256/4 |
| 2,537,719 | 1/1951 | Tuepker | 248/228 X |
| 3,043,354 | 7/1962 | Fitzgerald | 220/4.23 |
| 3,454,261 | 7/1969 | Nachazel | 256/2 |
| 4,244,490 | 1/1981 | Burnham | 220/4.25 X |
| 4,523,745 | 6/1985 | Killman et al. | 256/1 |
| 4,755,633 | 7/1988 | Standing | 256/4 X |

FOREIGN PATENT DOCUMENTS

| | | | |
|---|---|---|---|
| 3704937 | 8/1988 | Fed. Rep. of Germany | 256/4 |

*Primary Examiner*—Randolph A. Reese
*Assistant Examiner*—Harry C. Kim
*Attorney, Agent, or Firm*—Dorr, Carson, Sloan & Peterson

[57] ABSTRACT

A protective device for covering a barb in a strand of barbed wire is disclosed. The barb has a plurality of outwardly extending points disposed around the strand with the strand extending axially outwardly from opposing sides of the barb.

In a first embodiment, the protective covering device of the present invention has an upper shell formed in a substantial hemisphere and a lower shell formed in a substantial hemisphere. A color agent may be optionally added to the upper and lower shells in order to provide high visibility when attached over the barb. A living hinge connects the upper and lower shells in a pivoting relationship so that the upper shell can pivot towards to lower shell. Male and female locking elements are provided on the upper and lower shells for locking the two hemispheres together over the barb. When locked, the barb is located in a formed hollow interior of the two shells and is fully protected from causing damage to animals and the like. The upper and lower shells have formed angular opening on opposing sides thereof so as to permit the passage of the strand through the protective covering device.

A second embodiment, a solid material, is placed or injected over the barb covering the extending points as well as a portion of the strand.

10 Claims, 3 Drawing Sheets

Fig. 3
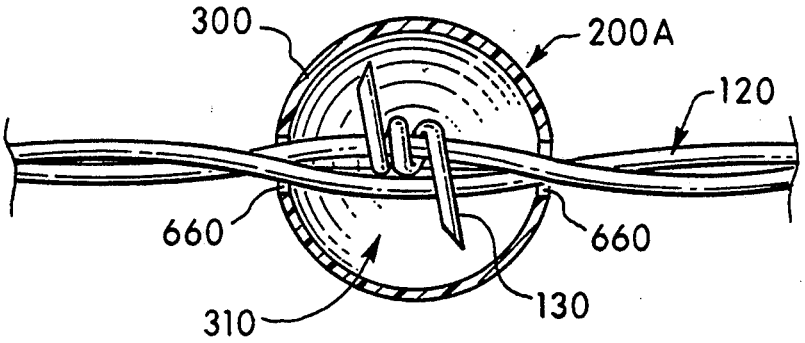
Fig. 4
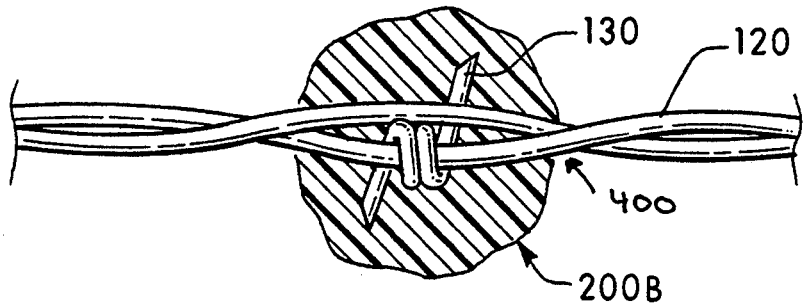
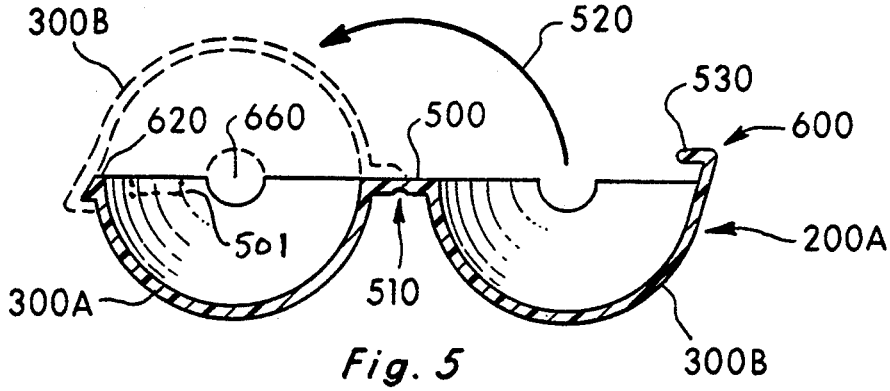
Fig. 5
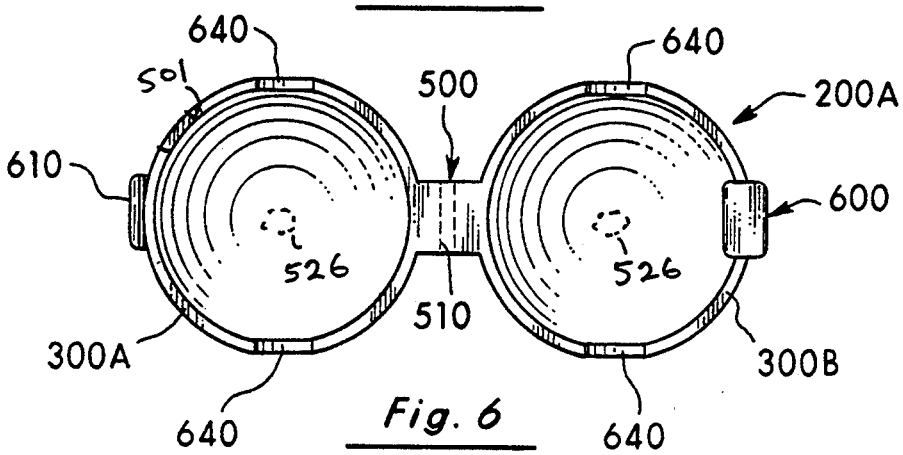
Fig. 6

PROTECTIVE BARB COVERINGS FOR BARBED WIRE

BACKGROUND OF THE INVENTION

1. Field of the Invention

The present invention relates to barbed wire and, more particularly, to providing protective coverings for the barbs on barbed wire.

2. Statement of the Problem

Barbed wire has been utilized for over a century to keep livestock, particularly cattle, within a parcel of land or to prevent animals and livestock from coming onto a parcel of land. A fence conventionally constructed of barbed wire usually has fence posts spaced from eight to twelve feet apart carrying three to five strands of barbed wire. The barbed wire has positioned at predetermined distances sharp and pointed barbs. Barbed wire and barbed wire fences function exceptionally well to contain livestock or to keep livestock out from parcels of land.

Many parcels of land undergo a change in the character of use from containing animals such as livestock to containing animals such as horses where the use of barbed wire is dangerous. It is well known that horses, especially if chased by dogs or spooked, can crash into barbed wire and severely lacerate their skin and perhaps permanently disable the horse which may result in the horse being put down. Barbed wire damage to horses, especially to expensive race, show, and performance horses is well known. A n e e d, therefore, exists to permit the full utilization of existing barbed wire fences to contain horses without risking laceration and other damage to the horse.

Smooth strand wire without barbs is typically used to confine horses on parcels of land. Many horse owners, upon purchasing parcels of land with barbed wire go to great expense to have the barbed wire removed and the smooth wire installed. It is expensive to remove barbed wire and it is expensive to reinstall smooth wire.

One problem with smooth wire is its invisibility or transparency to the horse. Many horse owners will affix pieces of cloth to the smooth wire or place a board or pipe across the top of the fence to provide the needed visibility. A need also exists to provide visibility for barbed wire fences.

3. Solution to the Problems

The present invention provides a solution to the above problem in a number of different embodiments. The present invention provides a protective, colored covering for each barb in a barbed wire strand. The protective covering fully covers each barb thereby rendering the sharp point ineffective. In one embodiment, the present invention provides a simple, plastic snap-on sphere that fully covers the barb. The sphere is designed to permanently snap-on and to withstand the environmental extremes a fence is subjected to.

In a second embodiment, the present invention provides an approach for forming a substantially spherical shape of material onto each barb so as to fully envelope the barb.

Under each embodiment, the protective covering can be composed of material in a variety of colors, even fluorescent colors, so as to provide substantial visibility for the fence. In a typical operation, the top barbed wire strand in a fence could utilize the colored protective coverings and the lower strands could use coverings of transparent material so as not to make the overall fence unacceptable to view.

The protective barbed coverings of the present invention are designed to be inexpensive, to be quickly installed onto barbs of existing barbed wire fences and to provide durability in the face of extreme environmental conditions.

SUMMARY OF THE INVENTION

A protective device for covering a barb in a strand of barbed wire is disclosed. The barb has a plurality of outwardly extending points disposed around the strand with the strand extending axially outwardly from opposing sides of the barb.

In a first embodiment, the protective covering of the present invention has upper and lower shells formed in substantial hemispheres. A living hinge connects the upper and lower shells in a pivoting relationship so that the upper shell can pivot towards to lower shell. Male and female locking elements are provided on the upper and lower shells for locking the two hemispheres together over the barb. When locked, the barb is located in a formed hollow interior of the two shells and is fully protected from causing damage to animals and the like. The upper and lower shells have formed annular opening on opposing sides thereof so as to permit the passage of the strand through the protective covering device. A color agent may be optionally added to the upper and lower shells in order to provide high visibility when attached over the barb.

A second embodiment, a solid material, is placed or injected over the barb covering the extending points as well as a portion of the strand.

BRIEF DESCRIPTION OF THE DRAWING

FIG. 3 is a cross-sectional view of the protective barb covering the first embodiment of the present invention;

FIG. 4 is a cross-sectional view of the protective barb covering of the second embodiment of the present invention;

FIG. 5 sets forth the cross-sectional side view of the protective covering of FIG. 3 of the present invention;

FIG. 6 sets forth a top planar view of the protective covering of FIG. 3 of the present invention.

DETAILED SPECIFICATION

Figure 1:
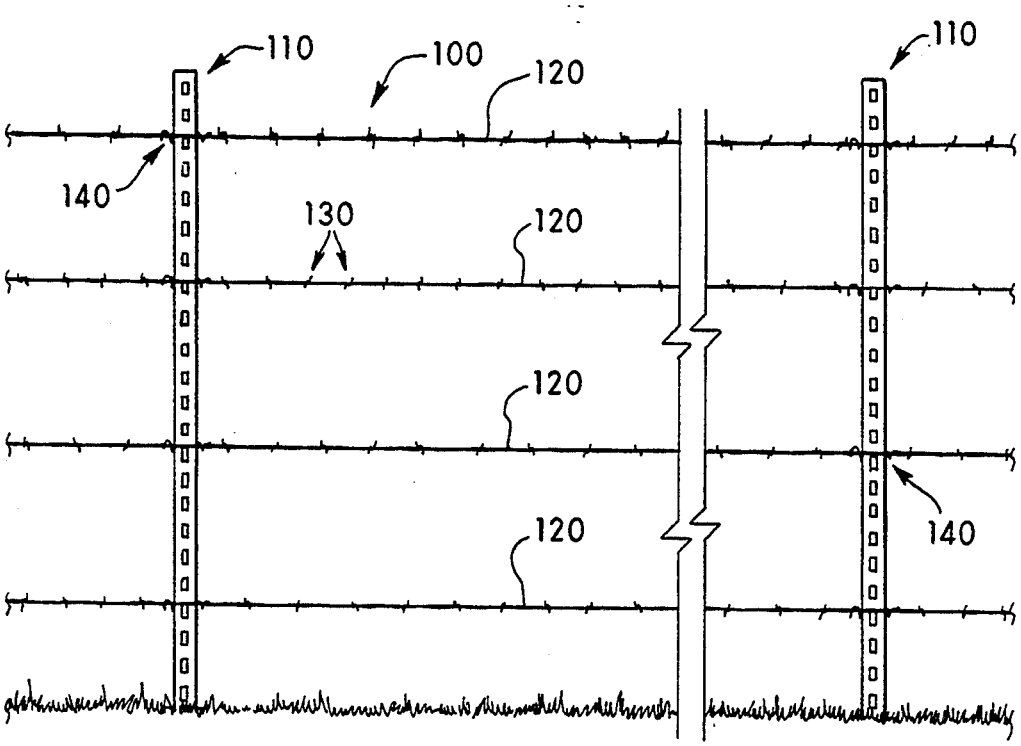
Fig. 1 (Prior Art)
FIG. 1 illustrates the prior art construction of a barbed wire fence.

In FIG. 1, a conventional barbed wire fence 100 is shown which includes a plurality of spaced posts 110, a plurality of barbed wire strands 120 affixed to the spaced posts 110, and a plurality of barbs 130 mounted to each strand 120. The construction of the barbed wire strands 120, the barbed wires 130 and the posts 110 is old and well known. The barbed wire strands 120 are mounted to the posts by means of wire fasteners 140.

Figure 2:
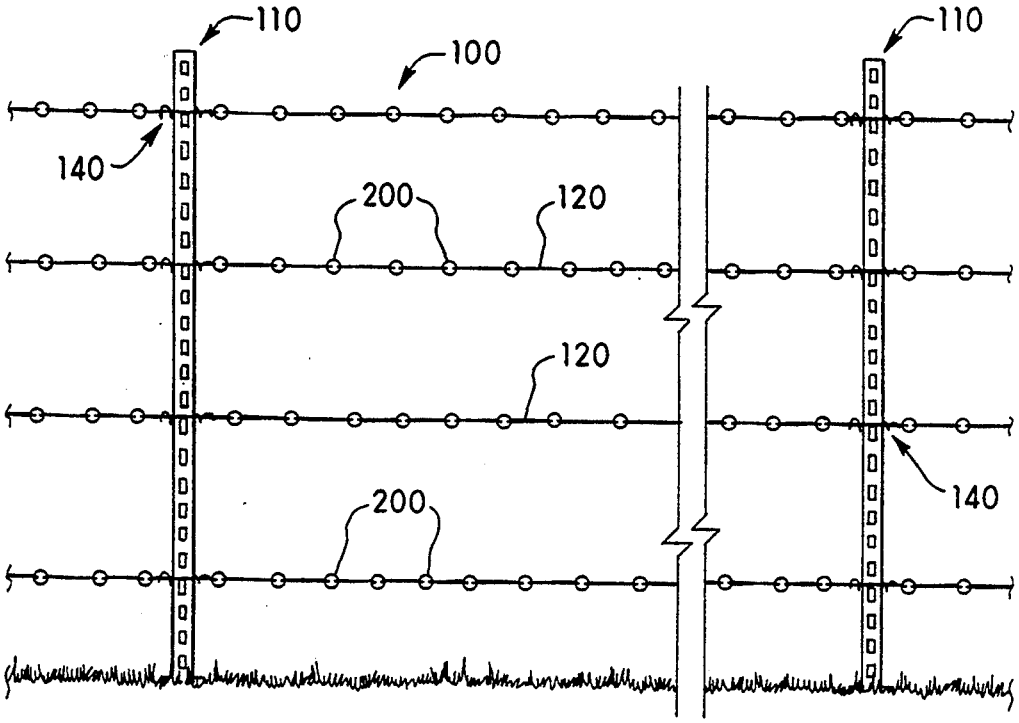
FIG. 2 illustrates the protective barb coverings of the present invention for the barbed wire fence FIG. 1.

In FIG. 2, the barbed wire fence 100 is shown to be barbs 130 covered with a protective covering 200 of the present invention.

FIRST EMBODIMENT

The first embodiment of the protective covering 200A is shown in FIGS. 3, 5, and 6. In this embodiment, a spherical shell 300 covering a hollow interior 310 is used to cover the barb 130 on the strand 120.

As shown in FIGS. 5 and 6, the protective covering 200A is comprised of two hemispherical elements or shells 300A and 300B. The two hemispherical elements 300A and 300B are connected by a substantially rectangular connector 500 in which is centrally formed a living hinge 510. This permits one of the hemispherical elements 300B (i.e., upper shell) to be moved upwardly in the direction of arrow 520 and to close over the remaining hemispherical element 300A (i.e., lower shell). Hemispherical element 300B has formed thereon a locking lip 600 which, as shown in FIG. 5, has a locking element 530 formed thereon (i.e., male locking element). The remaining hemispherical element 300A has a formed engagement ridge 610 which has a formed flat surface 620 formed thereon (i.e., female locking element).

As shown in FIG. 5, when hemispherical element 300B closes over hemispherical element 300A, the locking lip 600 latches over engagement ridge 610 so that the locking element 530 engages flat surface 620 as shown in FIG. 5. Once locked, the spherical protective covering 200A remains locked. It is to be expressly understood that with force, locking lip 600 can disengage from engagement ridge 610 thereby causing the protective covering 200A to open.

Each hemispherical element 300A and 300B has formed annular surfaces 640. These formed annular surfaces 640 create a circular opening 660 as shown in FIG. 5. These circular openings 660, as shown in FIG. 3, permit the protective covering 200A to be disposed round the wire strand 120. Hence, the diameter of the circular openings 660 is such that they are slightly larger than the diameter of the strand 120. Likewise, the diameter of the interior hollow region 310 is such that it is greater than the outwardly extending barbs 130 as shown in FIG. 3.

The size of the sphere 200 can be of any convenient diameter such that the diameter is larger than a conventional barb 130 such as about ¾ inch and to be as large as desired although it is believed a preferred range would be about ¾ inch to about 3 inches. The thickness of the shell 300A also can be any suitable thickness such as about 1/16 inch to about ½ inch. The diameter of the strand 120 is about 3/16 inch and the annular region 660 is greater than about 3/16 inch in diameter.

A number of variations on the design of the protective covering 200A, in this embodiment, can be created. For example, the living hinge 510 can be of any suitable design. The locking lip 600 and the ridge 610 can also be of any suitable locking design and construction. Likewise, the shape of the rectangular region 500 can be of any suitable shape and the present invention is not to be so limited. The present invention is not to be limited to the design shown in FIGS. 5 and 6. Indeed, while a spherical shape is preferred, it is to be understood that any desirable shape which serves the same function could be utilized, such as an oval shape. Furthermore, the upper and lower shells may be of two separate shells 300A and 300B which use a male/female locking element on opposing sides without use of a hinge 500. All of these variations and any others which serves to perform the inventive protective covering 200A over each of the outwardly extending points of the barb 130 will suffice. A slot (as shown by dotted lines 501) can be optionally provided between the shells 300A and 300B for use by a device such as a screwdriver to selectively open the shells at a later date if desired. Drainage holes 526 can also be optionally provided to prevent build-up of moisture with the sphere (as only shown in FIG. 6).

SECOND EMBODIMENT

Figure 7:
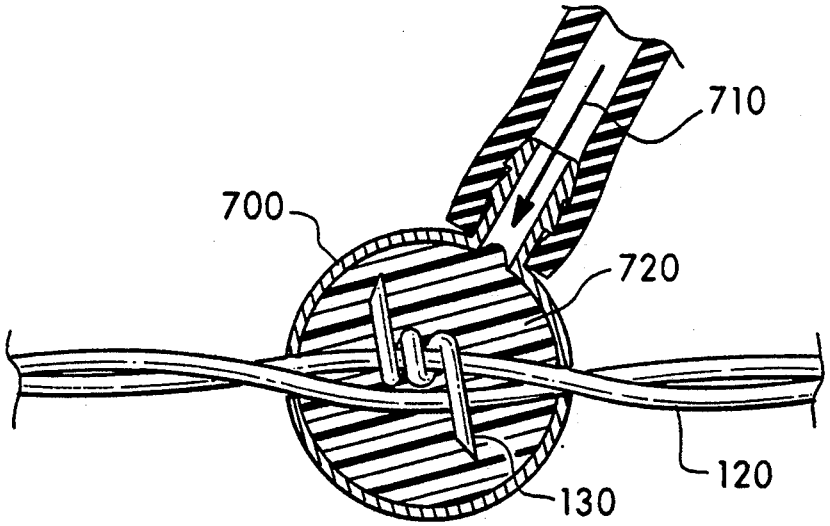
FIG. 7 sets forth the apparatus for forming the protective covering of the second embodiment of the present invention as shown in FIG. 4.

In FIGS. 4 and 7, the second embodiment is set forth. In this embodiment, an applicator 700 is used to apply a plastic substance 720 in the direction of arrow 710 into the interior of the applicator 700 so as to surround the barb 130 on the strand 120. The substance 720 dries to form protective covering 200B as shown in FIG. 4. Protective covering 200B is substantially spherical in shape and fully covers the barb 130 while still permitting passage of strand 120 in region 400. Any suitable shape is contemplated under the teachings of this invention such as an ellipsoid. The applicator 700 is hinged so as to be quickly and easily opened and then closed to cover a barb 130 and then reopened after application. It is to be understood that the material constituting the covering 200B can be applied in direction of arrow 710 either by means of a device such as a conventional caulking gun or by means of an air pressure powered apparatus or any other suitable forcing means.

In the second embodiment of the present invention, a solid protective covering 200B is applied. While the present invention contemplates using a silicone rubber sealant such as a conventionally available silicon caulking substance which has a useful life of 25–50 years. It is to be understood that any suitable solid protecting substance of any other plastic variety having excellent weather and sun enduring capabilities could also be used. A solid metallic type of substance provided by heat such as solder or the like could also be utilized or any other suitable solid protective substance.

VISIBILITY

Both of the aforesaid embodiments of the present invention provide a mechanical device for imparting high visibility to a fence. The protective covering 200 can be made with a suitable color agent so as to provide high visibility to the barbed wire fence. Indeed, fluorescent coloring can be added so as to provide visibility at night time. The visibility aspect of the present invention is an important feature. Hence, the present invention provides a protective, colored covering for each barb in a barbed wire strand. For example, the top strand in a fence may utilize high visibility coloring whereas the other protective coverings on the lower strands may be of clear or transparent coloring.

Two embodiments of the present invention have been described. Both embodiments set forth a device that provides a protective covering over each of the plurality of outwardly extending points of a barb and provide a passageway through the covering to permit passage of the strand. Other embodiments could be designed under the teachings of this invention to accomplish this result.

The present invention is not to be limited by the description of the above exemplary embodiment. The configuration of the system of the present invention encompasses other embodiments and variations as well as applied in a number of differing applications within the scope of the present inventive concept as set forth in the following claims.

I claim:

1. An improvement for a strand of barbed wire, said strand having an individual barb on a portion of said strand, said barb having a plurality of outwardly extending points disposed around said portion of said strand, said strand extending axially outwardly from opposing sides of said individual barb, wherein said improvement comprises in combination:

means over said individual barb for providing a protective covering over each of said plurality of outwardly extending points of said individual barb, each of said plurality of outwardly extending points of said individual barb being fully enclosed within said protective covering, and means cooperative with said providing means for permitting passage of said strand through said providing means, said providing means only covering said individual barb and said portion of said strand.

2. The improvement of claim 1 further comprising a color agent added to said providing means so as to provide visibility to said providing means.

3. The improvement of claim 1 wherein said providing means comprises:

material formed in a substantial sphere around said individual barb, said permitting means comprising formed annular openings on opposing sides of said sphere so as to permit the passage of said strand through said providing means.

4. The improvement of claim 3 wherein said material formed in said substantial sphere comprises:

an upper hemisphere, a lower hemisphere, means connecting said upper and lower hemispheres in a pivoting relationship so that said upper hemisphere can pivot towards said lower hemisphere, means on said upper and lower hemispheres for locking said upper and lower hemispheres together over said individual barb.

5. The improvement of claim 1 wherein said providing means comprises a solid material engaging said individual barb for fully covering said each of said outwardly extending points.

6. An improvement for a strand of barbed wire, said strand having an individual barb on a portion of said strand, said barb having a plurality of outwardly extending points disposed around said portion of said strand, said strand extending axially outwardly from opposing sides of said individual barb, wherein said improvement comprises in combination:

an upper shell formed in a substantial hemisphere, a lower shell formed in a substantial hemisphere, means connecting said upper and lower hemispheres in a relationship so that said upper hemisphere can pivot towards said lower hemisphere, means on said upper and lower shells for locking said upper and lower hemispheres together over said individual barb and said portion of said strand, said upper and lower shells when locked by said locking means forming a hollow interior in which said individual barb and said portion of said strand is fully contained, each of said plurality of outwardly extending points of said individual barb being contained within said hollow interior, said upper and lower shells having formed annular openings on opposing sides thereof so as to permit the passage of said strand through said upper and lower shells when locked by said locking means.

7. The improvement of claim 6 further comprising a color agent added to said upper and lower shells so as to provide visibility.

8. The improvement of claim 6 wherein said connecting means comprises a living hinge.

9. An improvement for a strand of barbed wire, said strand having an individual barb on a portion of said strand with said barb having a plurality of outwardly extending points disposed around said portion of said strand, said strand extending axially outwardly from opposing sides of said individual barb, wherein said improvement comprises in combination:

an upper shell, a lower shell, a color agent added to said upper and lower shells in order to provide visibility, a living hinge connecting said upper and lower shells in a pivoting relationship so that said upper shell can pivot towards said lower shell, a male locking element on said upper shell and a female locking element on said lower shell for locking said upper and lower shells together over said individual barb and said portion of said strand, said upper and lower shells when locked by said male and female locking elements forming a hollow interior in which said barb is contained, each of said plurality of outwardly extending points of said individual barb being fully contained within said protective covering, said upper and lower shells having formed annular openings on opposing sides thereof so as to permit the passage of said strand through said upper and lower shells.

10. An improvement for a strand of barbed wire, said strand having an individual barb on a portion of said strand with said barb having a plurality of outwardly extending points disposed around said portion of said strand, said strand extending axially outwardly from opposing sides of said individual barb, wherein said improvement comprises in combination:

solid material engaging said individual barb for covering each of said outwardly extending points, each of said plurality of outwardly extending points of said individual barb and said portion of said strand being fully enclosed within said protective covering, and a formed annular region through said solid material to permit the passage of said strand through said solid material.

* * * * *